US009418527B2

(12) United States Patent
Frasure et al.

(10) Patent No.: US 9,418,527 B2
(45) Date of Patent: Aug. 16, 2016

(54) PNEUMATIC DETECTOR SWITCH HAVING A SINGLE DIAPHRAGM FOR ALARM AND FAULT CONDITIONS

(71) Applicant: Kidde Technologies, Inc., Wilson, NC (US)

(72) Inventors: David Frasure, Wilson, NC (US); Scott K. Newlin, Wilson, NC (US); Steven Wallace, Wilson, NC (US)

(73) Assignee: Kidde Technologies, Inc., Wilson, NC (US)

( * ) Notice: Subject to any disclaimer, the term of this patent is extended or adjusted under 35 U.S.C. 154(b) by 66 days.

(21) Appl. No.: 14/163,350

(22) Filed: Jan. 24, 2014

(65) Prior Publication Data

US 2015/0097677 A1 Apr. 9, 2015

Related U.S. Application Data

(60) Provisional application No. 61/886,256, filed on Oct. 3, 2013.

(51) Int. Cl.

| | |
|---|---|
| ***G08B 17/04*** | (2006.01) |
| ***G08B 29/04*** | (2006.01) |
| ***H01H 35/34*** | (2006.01) |

(52) U.S. Cl.

CPC ..... *G08B 17/04* (2013.01); *G08B 29/043* (2013.01); *H01H 35/346* (2013.01)

(58) Field of Classification Search

CPC ..... Y10T 137/3631; Y10T 137/8326; A62C 35/64; G08B 17/04

USPC ..... 340/592, 626, 593; 200/83 R

See application file for complete search history.

(56) References Cited

U.S. PATENT DOCUMENTS

| | | | | |
|---|---|---|---|---|
| 1,986,479 | A * | 1/1935 | Lowe | H01H 35/346 116/5 |
| 3,122,728 | A | 2/1964 | Lindberg, Jr. | |
| 3,760,393 | A * | 9/1973 | Lindberg | 340/508 |
| 4,049,935 | A | 9/1977 | Gruber | |
| 4,211,901 | A | 7/1980 | Matsuda et al. | |
| 4,975,679 | A | 12/1990 | Ballyns | |
| 5,136,278 | A * | 8/1992 | Watson et al. | 340/592 |
| 5,225,643 | A * | 7/1993 | Marchant | 200/83 Y |
| 5,691,702 | A * | 11/1997 | Hay | 340/626 |
| 6,121,883 | A * | 9/2000 | Hatsir | 340/584 |
| 2005/0139796 | A1 * | 6/2005 | Altonji | 251/63.5 |
| 2009/0236205 | A1 * | 9/2009 | Nalla | G08B 17/04 200/81.4 |
| 2011/0121977 | A1 | 5/2011 | Nalla et al. | |
| 2014/0266746 | A1 * | 9/2014 | Rennie et al. | 340/626 |
| 2014/0320292 | A1 | 10/2014 | Rennie et al. | |

OTHER PUBLICATIONS

Search Report and Opinion issued by the European Patent Office on Feb. 17, 2015 for European Patent Application No. 14184634.

* cited by examiner

*Primary Examiner* — Phung Nguyen

(74) *Attorney, Agent, or Firm* — Locke Lord LLP; Scott D. Wofsy; Christopher J. Cillié

(57) ABSTRACT

A pneumatic pressure detector switch is disclosed that includes a retainer assembly adapted to communicate with a source of pressure, a deformable diaphragm supported within the retainer assembly and movable in response to changes in pressure communicated to the retainer assembly, a fault contact element supported by the retainer assembly adjacent a first side surface of the diaphragm, and an alarm contact element supported by the retainer assembly adjacent a second side surface of the diaphragm.

13 Claims, 4 Drawing Sheets

NORMAL PRESSURE CONDITION

ALARM CONDITION

PNEUMATIC DETECTOR SWITCH HAVING A SINGLE DIAPHRAGM FOR ALARM AND FAULT CONDITIONS

CROSS-REFERENCE TO RELATED APPLICATION

This application claims the benefit of priority to U.S. Provisional Patent Application No. 61/886,256 filed Oct. 3, 2013 which is incorporated by reference herein in its entirety.

BACKGROUND OF THE INVENTION

1. Field of the Invention

The subject invention relates generally to a pneumatic switch for fire detection, and more particularly, to a pneumatic detector switch having a single deformable diaphragm for indicating alarm and fault conditions.

2. Description of Related Art

The reliable detection of fire in commercial and military vehicles and aircraft is a critical function. A well-known prior art fire detection system includes a titanium or vanadium wire contained in a pressurized sensor tube. During fabrication, the wire is exposed to high temperature and pressurized hydrogen gas, which it absorbs while cooling. The hydrogen saturated wire is inserted into a sensor tube, pressurized with an inert gas, and then sealed at both ends to form a pressure vessel.

One end of the pressure vessel is then incorporated into a housing that comprises a hermetically sealed and pressurized plenum, wherein pneumatic detector switches are located. When the sensor tube is exposed to high temperature, for example, in the event of a fire or overheat condition in the vehicle, the pressure inside the vessel will rise, impacting the pneumatic detector switches.

Typically, prior art fire alarm systems use two separate pneumatic detector switches, one for indicating an alarm condition and another for indicating a fault condition. The pneumatic detector switches are typically deformable metallic diaphragms that are adapted and configured to move between open and closed switch positions in response to variations in the background pressure within the plenum.

When a deformable diaphragm is employed as an alarm switch, the open switch condition corresponds to a low or normal pressure condition in the plenum, whereas the closed switch position corresponds to a high pressure condition in the plenum. In the open switch position, the diaphragm is not in electrical contact with the alarm circuit. Conversely, in the closed switch position, when there is a high pressure condition in the plenum resulting from a fire or an overheat condition, the diaphragm makes electrical contact with a circuit to activate an alarm.

When a diaphragm is employed as a fault or integrity switch, the closed switch position corresponds to a normal pressure condition in the plenum, whereas the open switch position corresponds to a low or below pressure condition in the plenum. In the closed switch position, the diaphragm makes electrical contact with the circuit to indicate system integrity. Conversely, in the open switch condition, the deformable diaphragm moves out of electrical contact with the fault circuit, indicting a fault condition or loss of pressure within the plenum.

To reduce the manufacturing cost and weight of a fire detection system used in vehicles and aircraft, it would be beneficial to provide a pneumatic detector switch having a single deformable diaphragm for indicating both alarm and fault conditions.

SUMMARY OF THE INVENTION

The subject invention is directed to a new and useful pneumatic pressure detector switch that utilizes a single diaphragm for indicating both alarm and fault conditions.

The detector switch includes a retainer assembly adapted to communicate with a source of pressure, a deformable diaphragm supported within the retainer assembly and movable in response to changes in pressure communicated to the retainer assembly, a fault contact element supported by the retainer assembly adjacent a first side surface of the diaphragm, and an alarm contact element supported by the retainer assembly adjacent a second side surface of the diaphragm.

Preferably, the fault contact element is a conduit providing communication between the source of pressure and the retainer assembly. The retainer assembly includes a fault retainer supporting the fault contact element and an alarm retainer supporting the alarm contact element. The diaphragm is supported between the fault retainer and the alarm retainer.

The diaphragm is insulated from the alarm retainer. In addition, the fault contact element is insulated from the fault retainer and the alarm contact element is insulated from the alarm retainer.

The first side surface of the diaphragm is spaced from the fault contact element and the second side surface of the diaphragm is spaced from the alarm contact element, when there is a normal pressure applied to the diaphragm.

The first side surface of the diaphragm contacts the fault contact element when there is a below normal pressure applied to the diaphragm. The second side surface of the diaphragm contacts the alarm fault contact element when there is an above normal pressure applied to the diaphragm.

The subject invention is also directed to a pneumatic pressure detector switch that includes a retainer assembly adapted to communicate with a source of pressure and defining an interior pressure chamber, a deformable diaphragm supported within the interior pressure chamber of the retainer assembly and movable therein in response to changes in pressure communicated to the pressure chamber of the retainer assembly, a fault contact pin supported by the retainer assembly and extending to the interior pressure chamber adjacent a first side surface of the diaphragm, and an alarm contact pin supported by the retainer assembly and extending to the interior pressure chamber adjacent a second side surface of the diaphragm.

Preferably, the fault contact pin is a conduit providing communication between the source of pressure and the interior pressure chamber of the retainer assembly.

The first side surface of the diaphragm is spaced from the fault contact pin and the second side surface of the diaphragm is spaced from the alarm contact pin, when there is a normal pressure applied to the diaphragm within the interior pressure chamber. The first side surface of the diaphragm contacts the fault contact pin when there is a below normal pressure applied to the diaphragm within the interior pressure chamber. The second side surface of the diaphragm contacts the alarm fault contact pin when there is an above normal pressure applied to the diaphragm within the interior pressure chamber.

The retainer assembly includes a fault retainer supporting the fault contact pin in an insulated manner and an alarm retainer supporting the alarm contact pin in an insulated manner, and wherein the diaphragm is supported between the fault retainer and the alarm retainer in an insulated manner.

These and other features of the pneumatic detection switch of the subject invention and the manner in which it is constructed and employed in a fire detection system will become more readily apparent to those having ordinary skill in the art from the following enabling description of the preferred embodiments of the subject invention taken in conjunction with the several drawings described below.

BRIEF DESCRIPTION OF THE DRAWINGS

So that those skilled in the art will readily understand how to make and use the pneumatic detector switch of the subject invention without undue experimentation, embodiments thereof will be described in detail herein below with reference to certain figures, wherein.

DETAILED DESCRIPTION OF PREFERRED EMBODIMENTS

Figure 1:
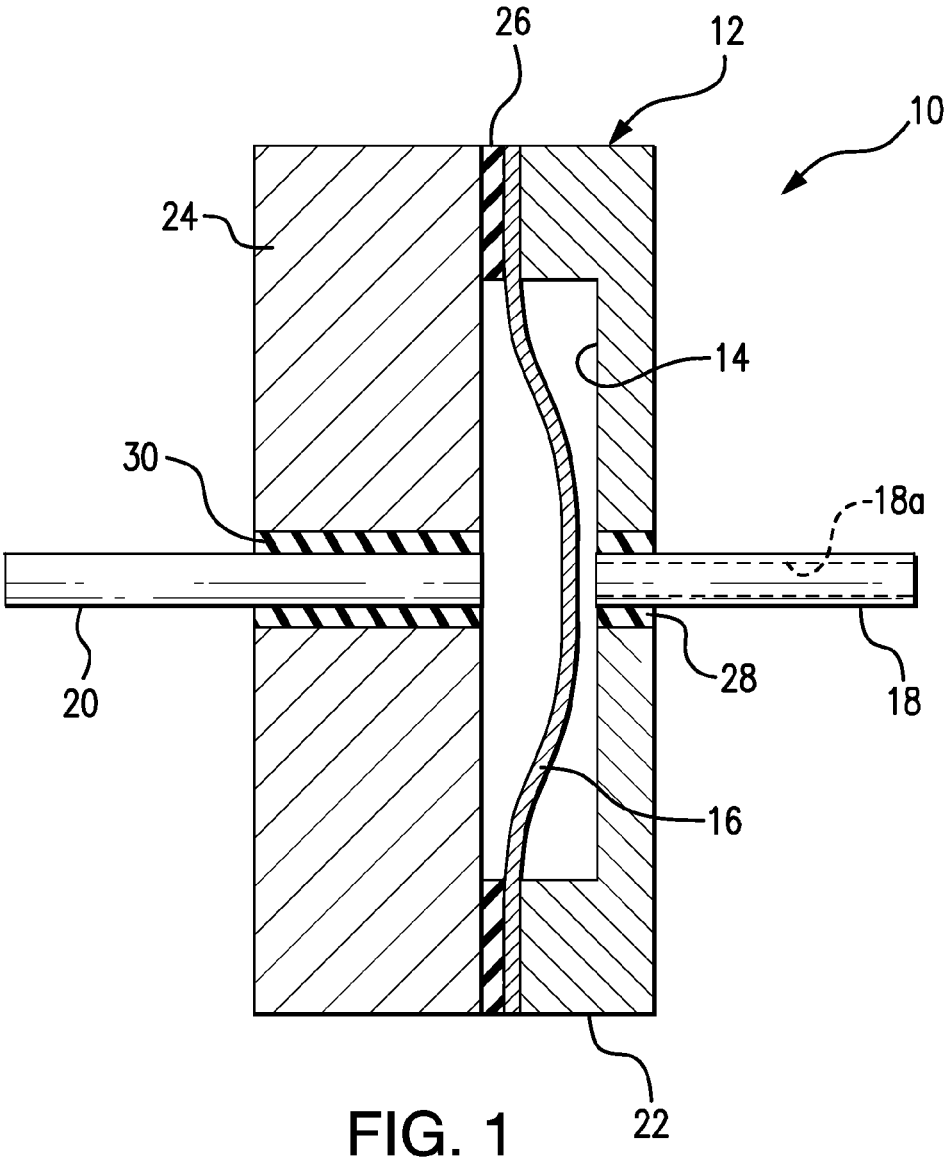
FIG. 1 is a cross-sectional view of a pneumatic detector switch having a single diaphragm for alarm and fault conditions, which is constructed in accordance with a preferred embodiment of the subject invention.

Referring now to the drawings, there is illustrated in FIG. 1 a pneumatic pressure detector switch constructed in accordance with a preferred embodiment of the subject invention and designated generally by reference numeral 10. Detector switch 10 includes a retainer assembly 12 adapted to communicate with a source of pressure and defining an interior plenum or pressure chamber 14.

The pressure source with which the retainer assembly 12 of detector switch 10 communicates may be a sealed pressure vessel housing a hydrogen saturated wire inserted into a sensor tube and pressurized with an inert gas, as is well known in the art. The retainer assembly 12 may be constructed from a metallic material such as molybdenum or the like.

A deformable metallic diaphragm 16 is supported within the interior pressure chamber 14 of the retainer assembly 12. The diaphragm 16 is preferably stamped from a flat metallic sheet and is pre-formed into the required shape prior to installation into the pressure chamber 14. A metal alloy of titanium, zirconium and molybdenum (TZM) is often utilized to construct such diaphragms.

The peripheral edge of the shaped diaphragm 16 is preferably brazed to the retainer assembly 12 to form the gas-tight seal. The diaphragm 16 is movable within the pressure chamber 14 in response to changes or variations in the pressure communicated to or otherwise within the pressure chamber 14 of the retainer assembly 12.

A fault contact pin 18 is supported by the retainer assembly 12 and it extends to the interior pressure chamber 14 adjacent a first side surface of the diaphragm 16. An alarm contact pin 20 is supported by the retainer assembly 12 and it extends to the interior pressure chamber 14 adjacent a second side surface of the diaphragm 16. The fault contact pin 18 includes a central conduit **18*a* providing communication between the source of pressure and the interior pressure chamber 14 of the retainer assembly 12**.

With continuing reference to FIG. 1, the retainer assembly 12 of detection switch 10 includes a fault retainer 22 supporting the fault contact pin 18 and an alarm retainer 24 supporting the alarm contact pin 20. The diaphragm 16 is supported between the fault retainer 22 and the alarm retainer 24.

The metallic diaphragm 16 is electrically insulated from the metallic alarm retainer 24 by an insulating washer 26. In addition, the metallic fault contact pin 18 is electrically insulated from the metallic fault retainer 22 by an insulating tube 28 and the metallic alarm contact pin 20 is electrically insulated from the metallic alarm retainer 24 by an insulating tube 30. The insulators may be made from a ceramic material or the like.

The diaphragm 16 should be designed to insure that electrical contact will be made when a predetermined threshold pressure is reached within the pressure chamber 14, corresponding to a certain threshold temperature for a given condition and application. Those skilled in the art will readily appreciate that the degree to which the diaphragm 16 deforms will be dependent upon the thickness and diameter of the diaphragm as well as its material of construction.

Figure 2:
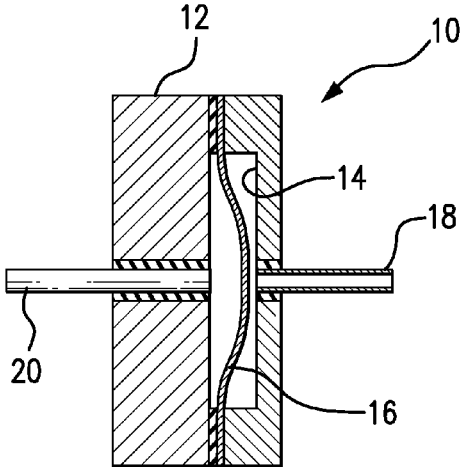
FIG. 2 is a cross-sectional view of the pneumatic detector switch of the subject invention under a normal pressure condition.

Referring to FIG. 2, there is illustrated the pneumatic detector switch 10 of the subject invention under a normal pressure condition. In this condition, the diaphragm 16 is out of contact with the fault contact pin 18 and the alarm contact pin 20. This corresponds to a normal condition in which there is no alarm or fault condition present.

Figure 3:
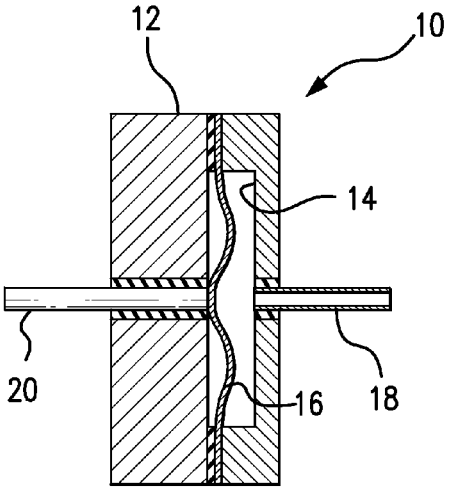
FIG. 3 is a cross-sectional view of the pneumatic detector switch of the subject invention under an above normal pressure condition.

Referring to FIG. 3, there is illustrated the pneumatic detector switch 10 of the subject invention under an above normal pressure condition. In this condition, the diaphragm 16 is out of contact with the fault contact pin 18 and it is in contact with the alarm contact pin 20. Moreover, there is electrical continuity between the diaphragm 16 and the alarm contact pin 20, and there is no electrical continuity between the diaphragm 16 and the fault contact pin 18. This corresponds to the existence of an alarm condition, such as a fire or overheat condition.

Figure 4:
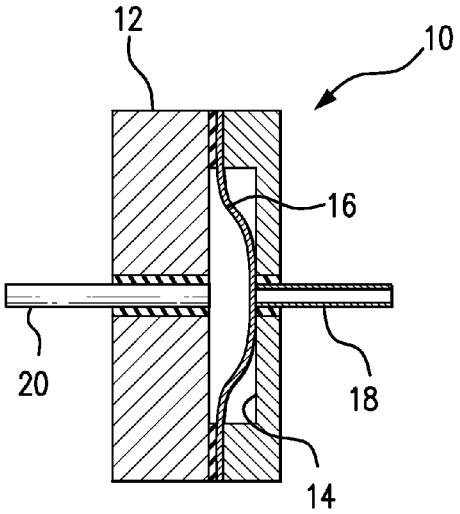
FIG. 4 is a cross-sectional view of the pneumatic detector switch of the subject invention under a below normal or null pressure condition.

Referring to FIG. 4, there is illustrated the pneumatic detector switch 10 of the subject invention under a below normal or null pressure condition. In this condition, the diaphragm 16 is in contact with the fault contact pin 18 and it is out of contact with the alarm contact pin 20. Moreover, there is no electrical continuity between the diaphragm 16 and the alarm contact pin 20, and there is electrical continuity between the diaphragm 16 and the fault contact pin 18. This corresponds to the existence of a fault condition, such as a loss of pressure within the detection system itself.

Figure 5:
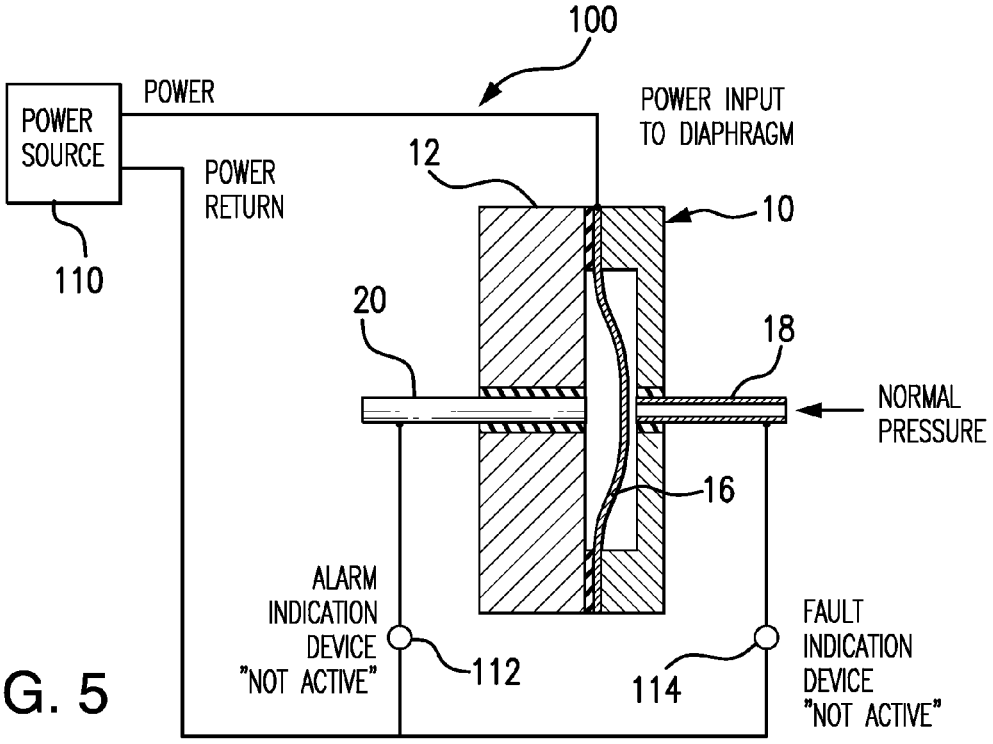
FIG. 5 is a schematic representation of an alarm circuit wherein the pneumatic detector switch of the subject invention is under a normal pressure condition as shown in FIG. 2.

Referring now to FIG. 5, there is illustrated a schematic representation of an alarm circuit 100 which includes the pneumatic detector switch 10 of the subject invention. The alarm circuit 100 includes a power source 110, an alarm indication device 112 and a fault indication device 114. The power source 110 is connected to the diaphragm 16. The alarm indication device 112 is connected to the power source 110 and to the alarm contact pin 20. The fault indication device 114 is connected to the power source 110 and to the fault contact pin 18.

As shown in FIG. 5, the pneumatic detector switch 10 is receiving a normal pressure flow through the conduit 18*a* of fault contact pin 18. The diaphragm 16 is therefore out of electrical contact with the fault contact pin 18 and the alarm contact pin 20. Accordingly, the alarm indication device 112 and the fault indication device 114 are both inactive. This is the normal operation state for the detector switch 10, with the lack of electrical continuity indicating the required minimal pressure resides within the switch.

Figure 6:
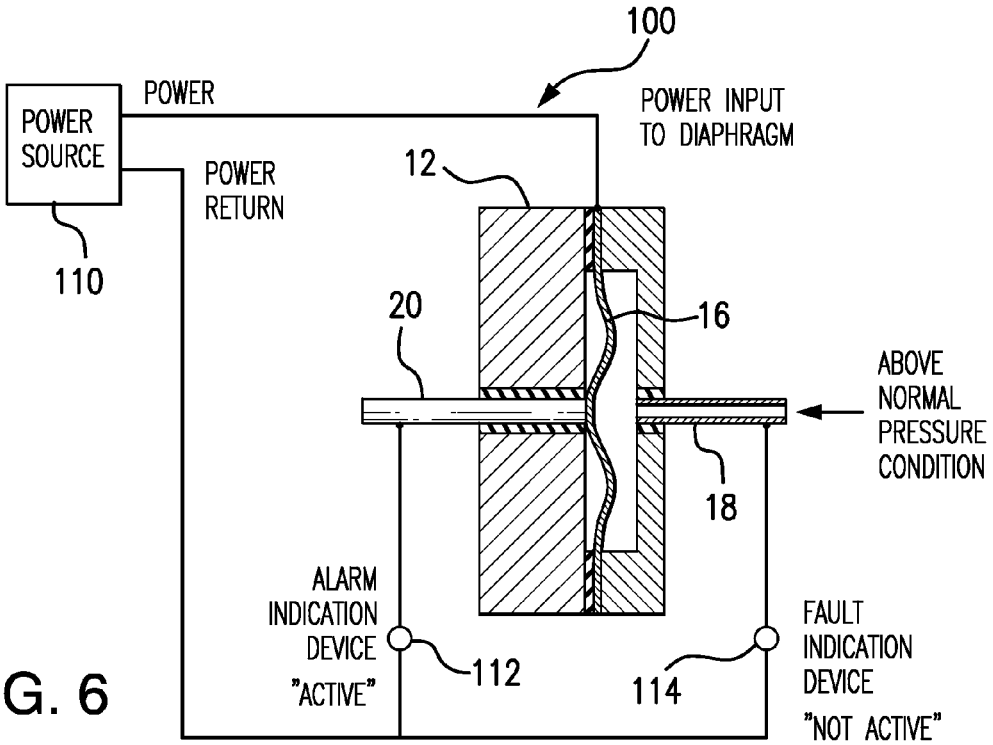
FIG. 6 is a schematic representation of an alarm circuit wherein the pneumatic detector switch of the subject invention is under an above normal pressure condition, as shown in FIG. 3.

Referring now to FIG. 6, the pneumatic detector switch 10 is receiving an above normal pressure flow through the conduit 18*a* of fault contact pin 18. The diaphragm 16 is therefore moved further away from the fault contact pin 18 and into electrical contact with the alarm contact pin 20. Accordingly, the alarm indication device 112 is active, while the fault indication device 114 is inactive.

Figure 7:
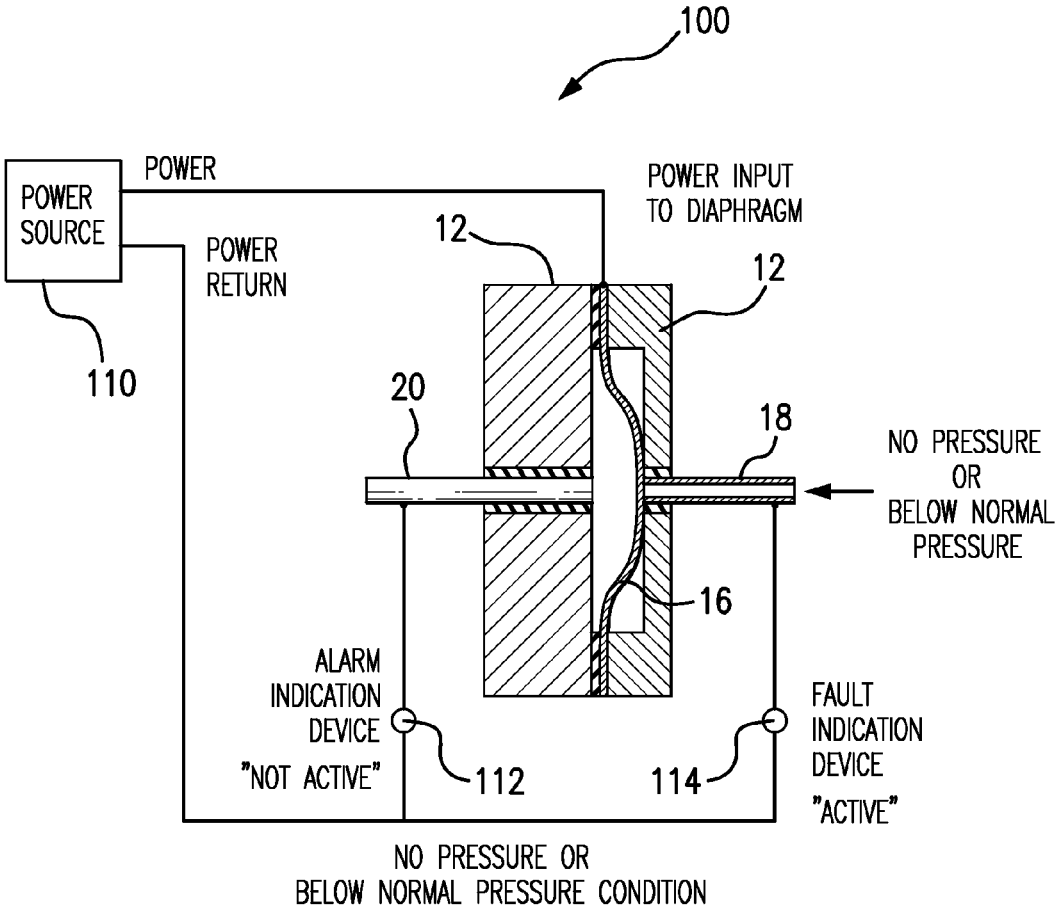
FIG. 7 is a schematic representation of an alarm circuit wherein the pneumatic detector switch of the subject invention is under a below normal pressure condition, as shown in FIG. 4.

Referring to FIG. 7, the pneumatic detector switch 10 is receiving a below normal pressure flow (or no pressure at all) through the conduit 18*a* of fault contact pin 18. The diaphragm 16 is therefore moved into electrical contact with the fault contact pin 18 and displaced further away from the alarm contact pin 20. Accordingly, the alarm indication device 112 is inactive, but the fault indication device 114 is active.

The minimum normal pressure within the chamber 14 of retainer assembly 12 is typically set at a pressure which is equivalent to the pressure at −65° F., but it can be lower or higher depending upon the specific application. In this condition, the pressure received by the switch 10 is not sufficient to keep the diaphragm 16 electrically separated from the fault contact pin 18.

The use of a single diaphragm switch will reduce manufacturing cost and the overall weight of the fire detection system, which is a critical factor for modern aerospace applications. However, it is envisioned that two switches could still be used to provide a redundant system. For example, if two switches were used, the diaphragm 16 and the fault contact pin/tube 18 from each switch could be electrically connected in series so that if either of the two switches fell below the minimal normal pressure, a fault condition would be indicated. Similarly, the diaphragm 16 and the alarm contact pin 20 of each switch could be electrically connected in parallel so if either of the two switches experienced an above normal pressure condition, an alarm condition would be indicated.

While the subject invention has been shown and described with reference to a preferred embodiment, those skilled in the art will readily appreciate that various changes and/or modifications may be made thereto without departing from the spirit and scope of the subject invention as defined by the appended claims.

What is claimed is:

1. A pneumatic pressure detector switch, comprising:

a) a retainer assembly adapted to communicate with a source of pressure;

b) a deformable diaphragm supported within the retainer assembly and movable in response to changes in pressure communicated to the retainer assembly;

c) a fault contact element supported by the retainer assembly adjacent a first side surface of the diaphragm; and d) an alarm contact element supported by the retainer assembly adjacent a second side surface of the diaphragm, wherein the fault contact element is a conduit providing communication between the source of pressure and the retainer assembly.

2. The pneumatic pressure detector switch as recited in claim 1, wherein the retainer assembly includes a fault retainer supporting the fault contact element and an alarm retainer supporting the alarm contact element.

3. The pneumatic pressure detector switch as recited in claim 2, wherein the diaphragm is supported between the fault retainer and the alarm retainer.

4. The pneumatic pressure detector switch as recited in claim 3, wherein the diaphragm is insulated from the alarm retainer.

5. The pneumatic pressure detector switch as recited in claim 2, wherein the fault contact element is insulated from the fault retainer and the alarm contact element is insulated from the alarm retainer.

6. The pneumatic pressure detector switch as recited in claim 1, wherein the first side surface of the diaphragm is spaced from the fault contact element and the second side surface of the diaphragm is spaced from the alarm contact element, when there is a normal pressure applied to the diaphragm.

7. The pneumatic pressure detector switch as recited in claim 6, wherein the first side surface of the diaphragm contacts the fault contact element when there is a below normal pressure applied to the diaphragm.

8. The pneumatic pressure detector switch as recited in claim 6, wherein the second side surface of the diaphragm contacts the alarm fault contact element when there is an above normal pressure applied to the diaphragm.

9. A pneumatic pressure detector switch comprising:

a) a retainer assembly adapted to communicate with a source of pressure and defining an interior pressure chamber; and b) a deformable diaphragm supported within the interior pressure chamber of the retainer assembly and movable therein in response to changes in pressure communicated to the pressure chamber of the retainer assembly, wherein the deformable diaphragm is in a first position when there is a normal pressure applied to the interior pressure chamber, a second position when there is a below normal pressure applied to the interior pressure chamber, and a third position when there is an above normal pressure applied to the interior pressure chamber, wherein a fault contact pin is a conduit providing communication between the source of pressure and the interior pressure chamber of the retainer assembly.

10. The pneumatic pressure detector switch as recited in claim 9, wherein the fault contact pin is supported by the retainer assembly and extends to the interior pressure chamber adjacent a first side surface of the diaphragm, and an alarm contact pin supported by the retainer assembly and extending to the interior pressure chamber adjacent a second side surface of the diaphragm.

11. The pneumatic pressure detector switch as recited in claim 10, wherein the first side surface of the diaphragm is spaced from the fault contact pin and the second side surface of the diaphragm is spaced from the alarm contact pin, when there is a normal pressure applied to the diaphragm within the interior pressure chamber.

12. The pneumatic pressure detector switch as recited in claim 10, wherein the first side surface of the diaphragm contacts the fault contact pin when there is a below normal pressure applied to the diaphragm within the interior pressure chamber.

13. The pneumatic pressure detector switch as recited in claim 10, wherein the second side surface of the diaphragm contacts the alarm fault contact pin when there is an above normal pressure applied to the diaphragm within the interior pressure chamber.

* * * * *